US005780775A

United States Patent [19]

Yu

[11] Patent Number: 5,780,775

[45] Date of Patent: Jul. 14, 1998

[54] POWER STRIP WITH INSPECTION WINDOW

[76] Inventor: Tsung-I Yu, No. 4, Alley 2, Lane 23, Sec. 3, Pa-Te Road, PanChiao City, Taipei Hsien, Taiwan

[21] Appl. No.: 821,340

[22] Filed: Mar. 20, 1997

[51] Int. Cl.[6] ..... H01R 25/00

[52] U.S. Cl. ..... 174/135; 439/910

[58] Field of Search ..... 174/135, 72 R, 174/48; 439/498, 535, 650, 209, 910

[56] References Cited

U.S. PATENT DOCUMENTS 5,383,799 1/1995 Fladung ..... 439/652

5,457,600 10/1995 Campbell et al. ..... 361/643

*Primary Examiner*—Kristine L. Kincaid
*Assistant Examiner*—Joseph Waks
*Attorney, Agent, or Firm*—Beveridge, DeGrandi, Weilacher & Young, LLP

[57] ABSTRACT

A power strip includes a casing on which at least one outlet is formed for the receiving of an external plug and a power cable extending from inside the casing to a terminal connector, such as a plug for connecting to an electric main. The casing is particularly provided with a window opening to expose the inside structure of the power strip with a transparent insulation cover removably mounted thereon to show the inside structure of the power strip.

6 Claims, 3 Drawing Sheets

POWER STRIP WITH INSPECTION WINDOW

FIELD OF THE INVENTION

The present invention relates generally to a power strip and in particular to a power strip with a transparent window mounted on the casing for inspection of the inside structure.

BACKGROUND OF THE INVENTION

Power strips or power cables with outlet connector that have at least one outlet are commonly known and widely used as an ancillary extension of for example wall outlet from an electric main. Commonly, the power strips have an insulation or dielectric casing inside which electric or electronic parts or elements are mounted. An extension cable extends from inside the casing to for example a plug adapted to connect to the wall outlet for supply of electricity from the wall outlet to the power strip or the parts or elements mounted therein. Hot contact and neutral contact and/or ground contact are provided on the casing for each of the outlets to receive a plug therein.

Conventionally, the casing is made of a non-clear plastic material, thus rendering the casing non-transparent, so that it is in general not possible to inspect, particularly visually, the inside structure without opening the casing which causes trouble in inspecting the inside structure by for example a buyer. Some of the advanced power strips comprise more valuable electronic devices, such as surge protection circuit. A buyer has to open the casing in order to make sure that the power strip which he or she purchases does have such electronic devices therein.

Further, in some of the conventional designs of the power strips, a fuse is encased inside the casing so that a user has to open the casing in order to inspect if the fuse is broken. This also happens to other electric or electronic devices that are mounted inside such a non-transparent casing.

Thus, to overcome such an inconvenience in the inspection of the inside of the power strip, it is desired to provide a casing with an inspection window to substantially expose the electric or electronic elements that require frequent inspection to ensure the proper operation of the power strip so as to allow a user to visually inspect the power strip without opening the casing.

SUMMARY OF THE INVENTION

The principal object of the present invention is to provide a power strip structure wherein the casing comprises at least a portion made of a transparent insulation material so as to allow a direct visual inspection of the inside of the power strip.

Another object of the present invention is to provide a power strip structure which has an inspection window provided on the non-transparent casing thereof to allow a buyer or a user to directly inspect the inside structure of the power strip.

A further object of the present invention is to provide a power strip with an opening on the casing which is preferably removably covered by a cover member so as to allow a user to repair or replace a broken element inside the power strip without opening the casing.

Yet a further object of the present invention is to provide a power strip structure with an inspection window provided on the non-transparent casing thereof to allow direct visual observation or inspection of the inside structure of the power strip so that there is no need to print the inside structure of the power strip on a packing material of the power strip and thus saving the cost and reducing the price of the power strip.

Thus, in accordance with the present invention, there is provided a power strip structure comprising a casing on which at least one outlet is formed for the receiving of an external plug and a power cable extending from inside the casing to a terminal connector, such as a plug for connecting to an electric main. The casing is particularly provided with an opening to expose the inside structure of the power strip with a transparent insulation cover removably mounted thereon to show the inside structure.

BRIEF DESCRIPTION OF THE DRAWINGS

The present invention will be better understood from the following description of a preferred embodiment thereof, with reference to the attached drawings, wherein.

DETAILED DESCRIPTION OF THE PREFERRED EMBODIMENT

Figure 1:
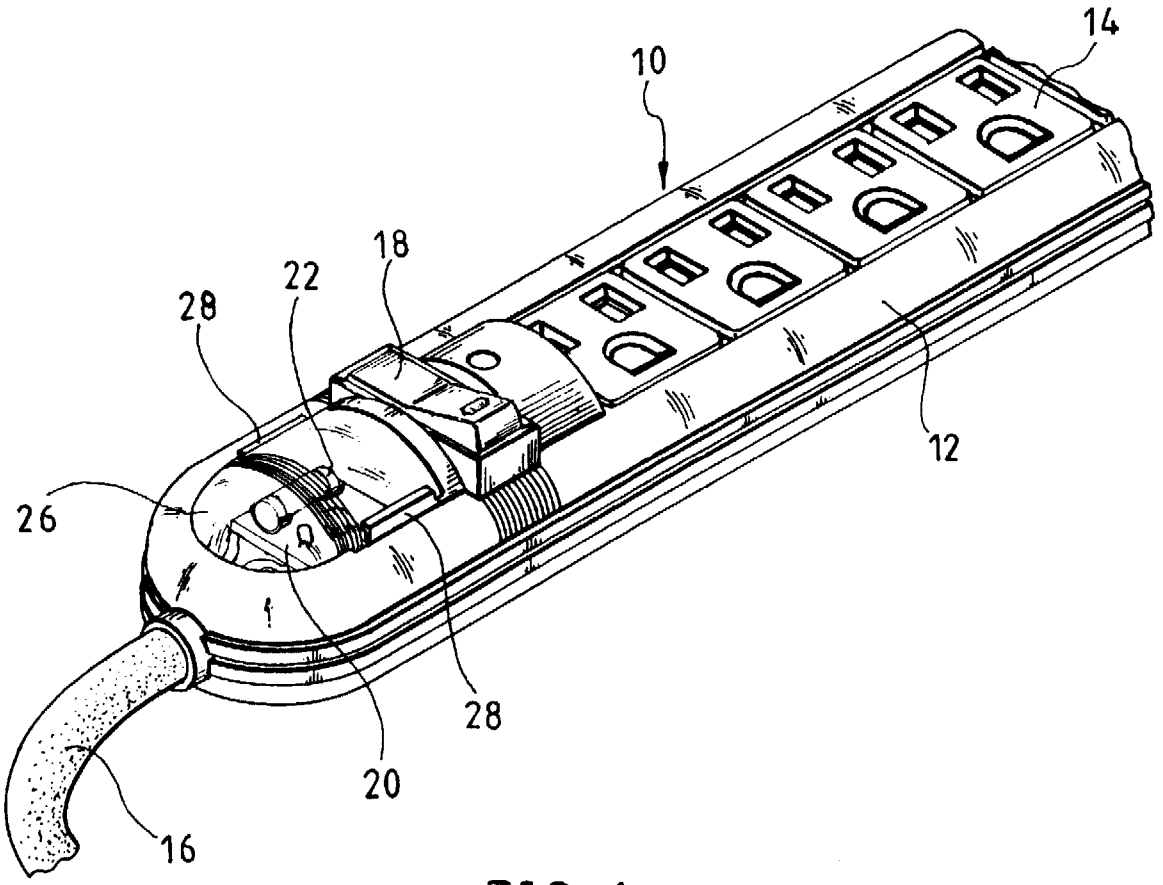
FIG. 1 is a perspective view showing a power strip constructed in accordance with the present invention.
Figure 2:
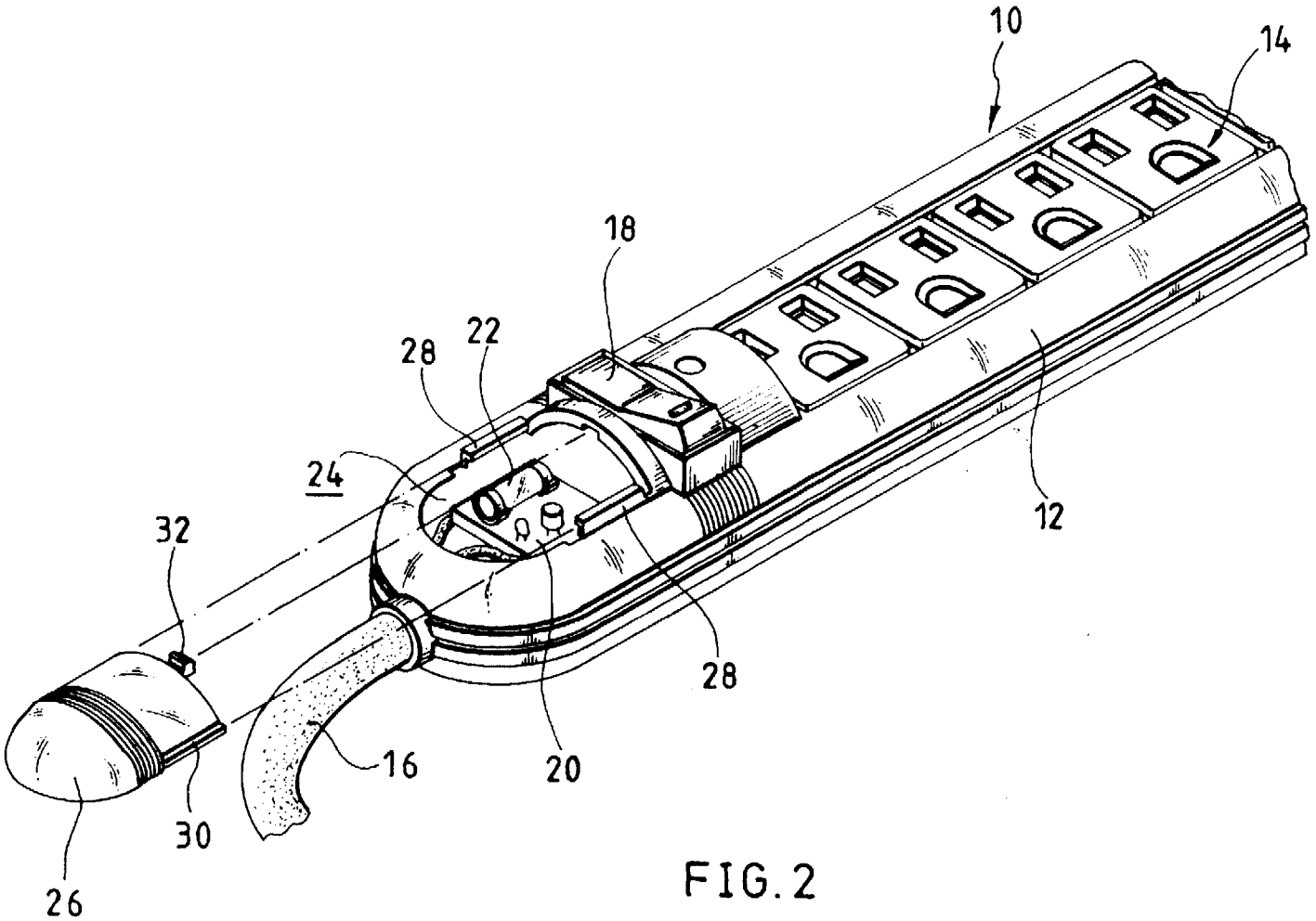
FIG. 2 is also a perspective view of the power strip of the present invention with the transparent window cover detached from the casing.

With reference to the drawings and in particular to FIGS. 1 and 2, which show a power strip constructed in accordance with the present invention, generally designated with reference numeral 10, the power strip 10 comprises an insulation casing 12 having a plurality of outlets 14 formed thereon adapted to each receive a plug of for example a household electric appliance therein. An extension cable 16 which extends from inside the casing 12 and in electrical connection with the outlets 14 is provided to connect to for example a wall outlet (not shown) for supply of electricity from the wall outlet to the power strip 10. A power on/off switch 18, which may be of any suitable configuration, is provided on the casing 18 and electrically connected between the extension cable 16 and the outlets 14 to selectively cut off the electricity supplied from the extension cable 16.

Illustratively, the power strip 10 may also be provided with an electrical circuit board 20 to function as for example a surge protector, an indicator of wiring fault or an audible or visual warning device and other desired functions. A fuse 22 is provided to protect the power strip 10 from overloading. The fuse 22 may be a part of the circuit board 20, as shown in the drawings. The power strip 10 may also comprise a variety of electric or electronic elements disposed inside the casing 12.

The structure described above is substantially identical to the prior art design of power strip, wherein the casing 12 is made of a non-transparent insulation material, such as an opaque plastic material so that the inside structure of the power strip is in general invisible.

In accordance with the present invention, the improvement of the power strip includes a window opening 24 formed on the casing 12, preferably in such a location to expose the electric or electronic elements disposed inside the casing 12, such as the electric circuit board 20 and the fuse 22, so as to allow a user to visually inspect the parts without opening the casing 12. A cover 26 (particularly seen in FIG. 2) made of a transparent insulation material, such as clear plastics, is removably attached to the casing 12 to completely shield the window opening 24.

Figure 3:
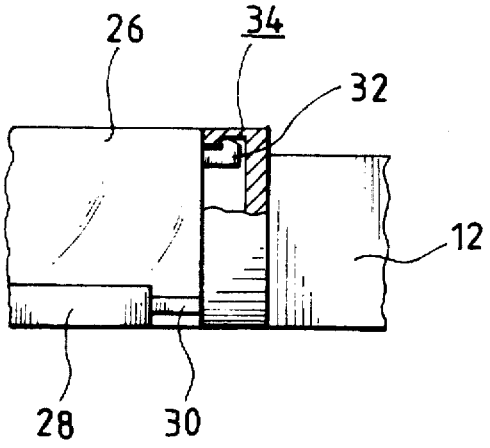
FIG. 3 is a partial sectional view of a portion of the window cover and the casing, showing the movable connection therebetween.
Figure 4:
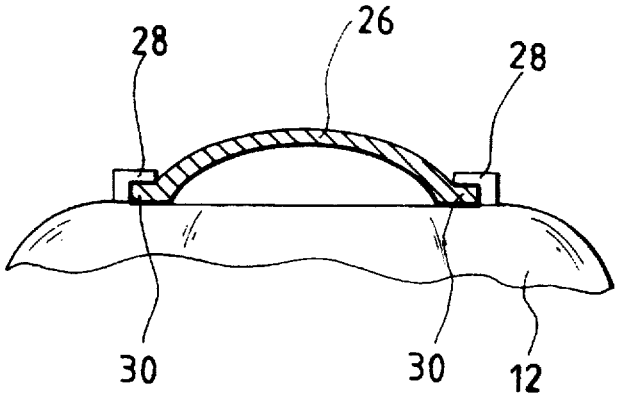
FIG. 4 is a cross-sectional view of the window cover and a portion of the casing showing the releasable retaining engagement between the window cover and the casing.

Any removable mounting of the cover 26 to the window opening 24 may be adapted to secure the cover 26 to the casing 12. As an example and shown in FIGS. 3 and 4, the window opening 24 is provided on two lateral edges with L-shaped flanges 28 facing each other and each defining a spacing with the casing 12 of the power strip 12 so as to constitute a pair of guide rails on the casing 12. Corresponding thereto, the cover 26 is provided on each of two opposite sides with a slide rim 30 to be slidably received within the spacing defined in the respective guide rail 28 (FIG. 4) so as to allow the cover 26 to be slidable relative to the guide rails 28 between an innermost closed position (FIG. 1) where the cover 26 completely shield and close the window opening 24 and a detached position (FIG. 2) where the slide rims 20 of the cover 26 are completely disengaged from the guide rails 28 so as to have the cover 26 detached from the casing 12.

The cover 26 is also provided with a retaining catch 32 which is preferably made resiliently deformable and is engageable with a notch 34 formed on the casing 12 so as to secure the cover 26 on the casing 12 at the closed position in a releasable manner.

The provision of the window opening 24 on the casing 12 of the power strip 10 allows a user or a purchaser to visually inspect the inside structure of the power strip 10 without opening the casing 12. The releasably mounting of the cover 26 on the window opening 24 also allows a user to access the electric elements inside the power strip 10 and thus allow ready repair or replacement of a broken element. The transparent shielding cover 26 prevents accidental contact of a person or a conductive article with the inside structure of the power strip which may cause electrical shock to the person or damage to the power strip. The transparent cover 26 also protects the power strip 10 from dust and debris (not shown).

Although a preferred embodiment has been described to illustrate the present invention, it is apparent that changes and modifications in the specifically described embodiment can be carried out without departing from the scope of the invention which is intended to be limited only by the appended claims.

What is claimed is:

1. A power strip structure, comprising:

an insulation casing having at least one outlet hole defined thereby and at least a window portion thereof being transparent;

and electric elements including a fuse or a circuit board disposed in the casing wherein the window portion of the casing is positioned above the electric elements inside the casing such that the electric elements are viewable from the outside of the casing through the window portion.

2. A power strip structure, comprising:

an insulation casing having at least one outlet hole defined thereby and defining an inspection opening; and electric elements including a fuse or a circuit board mounted therein, wherein said inspection opening is positioned above the electric elements inside the casing such that the electric elements are viewable from the outside of the casing through the inspection opening.

3. The power strip structure as claimed in claim 2, further comprising:

a shielding cover made of a transparent material removably received in the inspection opening.

4. The power strip structure as claimed in claim 3, further comprising:

retaining means, provided between the cover and the inspection opening of the casing, for releasably securing the cover in the opening.

5. The power strip structure as claimed in claim 4, wherein the retaining means comprises an L-shaped raised strip provided on each of two opposite edges of the opening defining a pair of guide rails slidably receiving slide rims formed on two opposite edges of the cover such that the cover is movable relative to the opening between a closed position, where the cover completely shields the opening, and a detached position, wherein the slide rims of the cover are completely disengaged from the guide rails and the cover is detached from the casing.

6. The power strip structure as claimed in claim 5, wherein the retaining means further comprises a retaining catch provided on the cover and engageable with a notch provided on the casing of the power strip such that the cover is releasably secured to the casing.

* * * * *